US008640505B2

(12) United States Patent
Bacelli et al.

(10) Patent No.: US 8,640,505 B2
(45) Date of Patent: Feb. 4, 2014

(54) ANCHORING SYSTEM OF COUNTERWEIGHTS FOR WASHERS AND WASHER/DRYER COMBOS

(75) Inventors: Gianfranco Bacelli, Jesi (IT); Stefano Mancini, Jesi (IT)

(73) Assignee: Meccanica Generale S.R.L., San Paolo di Jesi (IT)

( * ) Notice: Subject to any disclaimer, the term of this patent is extended or adjusted under 35 U.S.C. 154(b) by 528 days.

(21) Appl. No.: 12/736,216

(22) PCT Filed: Feb. 17, 2009

(86) PCT No.: PCT/EP2009/051859

§ 371 (c)(1),
(2), (4) Date: Sep. 20, 2010

(87) PCT Pub. No.: WO2009/118220

PCT Pub. Date: Oct. 1, 2009

(65) Prior Publication Data

US 2011/0000265 A1 Jan. 6, 2011

(30) Foreign Application Priority Data

Mar. 27, 2008 (IT) ..... MC2008A0050

(51) Int. Cl.
*D06F 37/20* (2006.01)

(52) U.S. Cl.
USPC ..... 68/140; 411/15; 411/40

(58) Field of Classification Search
USPC ..... 68/140; 411/15, 44, 17
See application file for complete search history.

(56) References Cited

U.S. PATENT DOCUMENTS

| | | | | | |
|---|---|---|---|---|---|
| 906,691 | A | * | 12/1908 | Chenoweth | 411/17 |
| 1,966,520 | A | * | 7/1934 | Rayner | 411/17 |
| 2,649,830 | A | * | 8/1953 | Arnold | 411/16 |
| 3,983,736 | A | * | 10/1976 | King, Jr. | 72/362 |
| 4,040,326 | A | * | 8/1977 | Breed | 411/378 |
| 4,309,135 | A | * | 1/1982 | Gutshall | 411/17 |
| 4,536,115 | A | * | 8/1985 | Helderman | 411/17 |
| 4,635,337 | A | * | 1/1987 | Helderman | 29/432 |
| 5,006,023 | A | * | 4/1991 | Kaplan | 411/17 |
| 2004/0013491 | A1 | * | 1/2004 | Park | 411/44 |

FOREIGN PATENT DOCUMENTS

| | | | |
|---|---|---|---|
| EP | 0 798 412 | A2 | 8/1997 |
| EP | 798412 | A2 * | 10/1997 |
| EP | 1 961 855 | A1 | 8/2008 |

OTHER PUBLICATIONS

HeliCoil Insert Systems, Emhart Teknologies, Aug. 2008.*

* cited by examiner

*Primary Examiner* — Michael Barr
*Assistant Examiner* — Kevin G Lee
(74) *Attorney, Agent, or Firm* — Lowe Hauptman & Ham, LLP

(57) ABSTRACT

The present invention relates to an anchoring system of counterweights for washers and washer/dryer combos based on the presence of a plurality of tubular divaricable pins (40, 41,42) on the external walls of the plastic molded tubs (1) that, after being inserted into through holes (21*a*) obtained on the said counterweights, are designed to receive suitable divaricating inserts (40*b*, 41*b*, 42*b*) to prevent uncoupling from the holes.

9 Claims, 8 Drawing Sheets

ANCHORING SYSTEM OF COUNTERWEIGHTS FOR WASHERS AND WASHER/DRYER COMBOS

TECHNICAL FIELD

The present patent application for industrial invention relates to an anchoring system of counterweights for washers and washer/dryer combos.

BACKGROUND

The peculiarities and advantages of the present invention will be more evident after a short description of the state-of-the-art.

With reference to FIG. 1, the current models of washers and washer/dryer combos are provided with a plastic tub with composite structure, being formed of two separate parts (1, 2) designed to be securely coupled by means of fixing means of known type.

The first part consists in a large concave cylindrical body (1) closed at one end by a bottom wall (10) with a central hole, connected on the back with a cylindrical nozzle (11) designed to exactly receive a metal bearing support with basically cylindrical shape.

The second part consists in a flange (2) provided with a large central opening (20*a*) designed to be mounted at the front open end of the concave cylindrical body (1).

Such a tub usually contains a cylindrical drum (3) designed to be loaded with dirty laundry through the opening (20*a*) of the front closing flange (2) of the tub.

The drum (3) is closed on the back by a bottom wall (30) with an axially protruding shaft (31) in central position, designed to be driven into rotation by the electrical motor that is normally mounted in the household appliance outside the tub.

In particular, the shaft (31) is designed to be inserted and supported, with the interposition of a pair of ball bearings with different diameter, inside the bearing support inserted in the nozzle (11) on the bottom wall (10) of the concave cylindrical body (1) of the tub.

The shaft (31) of the drum (3) is driven into rotation by a motor fixed in external position on the tub.

Moreover, such a traditional tub is fixed inside the cabinet of the washer by means of suitable elastic means, which are also designed to act as shock absorbers for the significant mechanical stress transmitted to the tub during the rotations of the drum, especially during spinning.

The presence of the elastic elements avoids the damages caused by the high stress to the structure of the tub.

The aforementioned tub-assembly is traditionally identified as "Oscillating Assembly".

The tendency of the laundry loaded inside the drum (3) to be arranged in a totally random way during the rotation of the drum (3) originates an unbalanced rotational mass associated with a centrifugal force that can reach very high values.

To counterbalance the centrifugal force and avoid the contact with the cabinet, the oscillating assembly must be ballasted up to a total weight normally ranging between 32 and 60 kg.

To reach such a weight counterweights (normally two, sometimes one or three) usually made of concrete must be anchored to the tub.

With reference to FIG. 2, to favour the anchoring and centring of the said counterweights (21), the cylindrical body (1), as well as the corresponding front flange (2), is externally provided with one or more cylindrical columns (22), each of them being internally provided with an axial rectilinear conduit (22*a*) designed to receive a corresponding self-tapping screw (24).

As shown in FIG. 2, each column (22) protrudes from a corresponding enlarged base with cylindrical shape (23).

Each counterweight (21) is provided with a through hole (21*a*), with basically truncated-conical shape, designed to receive one of the said columns (22) when the counterweight is engaged against the upper side of the corresponding enlarged base (23).

In this way the upper end of each column (22) can be accessed from the upper opening of the hole (21*a*) of the counterweight (21) to allow for engagement with the self-tapping screw (24).

The self-tapping screw (24) is generally provided with a large washer (26) designed to be energetically engaged around the upper opening of the hole (21*a*) of the counterweight (21).

The careful examination of a similar prior technique has shown critical aspects that can be remedied by the present invention.

A first severe limitation of the said traditional columns (22) relates to the operation principle.

Reference is made to the fact that the mutual coupling between the column (22) and the hole (21*a*) of the counterweight (21) is obtained because of the compression and permanent deformation of the plastic material of the column (22).

More precisely, the said deformation is produced in the upper end of the enlarged base (23) of each column (22) because of the energetic interference produced by the lower opening of the hole (21*a*) of the counterweight (21) following to the progressive tightening of the screw for mutual fixing (24).

In fact, due to the tightening of the screw, the plastic material of the base (23) of the column (22)—being generally reinforced or loaded polypropylene material—tends to be moulded and forcedly adhered against the surface of the counterweight (21).

In this condition the anchoring of the counterweight is not completely satisfactory, since the counterweight may be moved from its operational position without control.

Such a case could occur, for example, in case of anomaly of the electronic system that controls the rotation of the said drum with the laundry.

In case of such an anomaly, the inertial force generated on the oscillating assembly of the washer may be so high that it cannot be efficaciously opposed by the front interference established between the plastic material of the base (23) and the concrete material of the counterweight (21).

Moreover, the traditional columns (22) have a very complex geometry that requires the use of a large quantity of plastic material as well as long cooling time at the end of the moulding operations.

In view of the above, the parts of the tub provided with the said columns (reference is made to the cylindrical body and corresponding closing flange) cannot be extracted from the corresponding moulds, although perfectly cooled, until the longer cooling process of the columns has been completed.

Because of the said cooling difficulties, undesired unexpected internal cavities may be formed on the structure of the columns, thus impairing the resistance and correct fixing with the counterweights.

In the worst cases the presence of the said internal cavities totally impairs the capability of a column to guarantee the anchoring of a corresponding counterweight because the self-tapping screw engaged inside it cannot reach the expected torque and loses its thread.

SUMMARY

The purpose of the present invention is to devise an anchoring system for counterweights that renounces the use of the traditional columns that cooperate with corresponding self-tapping screws, in favour of corresponding tubular cylindrical pins made of plastic material, which are provided with intrinsic elastic deformability because of the presence of longitudinal notches.

Like traditional columns, also the deformable pins are incorporated in external position on the tub of a washer or a washer/dryer combo during the moulding of the tub, being designed to be inserted from down up inside the holes of the corresponding counterweights, in such a way that their end can be accessed from the upper opening of the same holes.

Moreover, it must be said that the holes of the counterweights are provided with truncated-conical shape with the end with lower cross-section facing the centre of the tub.

Once each pin is inserted into the hole of the corresponding counterweight, a suitable elastic insert (a sort of plug) with truncated-conical shape must be inserted inside it.

Considering that each pin is provided with longitudinal notches, it is evident that the forced engagement of the corresponding insert inside it causes elastic divarication that determines its truncated-conical shape.

In this way the external walls of the pin can be energetically compressed against the internal walls of the truncated-conical hole obtained in the corresponding counterweight.

The considerable divaricating force exerted by the elastic insert on the walls of a similar tubular pin, in combination with the truncated-conical shape of the hole of the counterweight, guarantees that the pin remains firmly locked in operational position, without the possibility to be accidentally removed from the hole or move inside it.

The higher reliability, in terms of anchoring of the counterweights, provided by the new divaricable pins compared to the traditional columns is due to the fact that, following to deformation, the section of the pins perfectly matches the truncated-conical shape of the hole of the counterweight, in such a way that a very large contact surface is established between the plastic is material of the pin and the concrete material of the counterweight, thus guaranteeing mutual stable anchoring also in extreme conditions and for long periods of time (in practical terms, for the entire operational life of the household appliance).

Moreover, it must be said that the use of the said divaricable pins in external position on a tub for washers or washer/dryer combos also involves other advantages both from the merely technical-functional and the economic viewpoint.

First of all, it must be noted that each pin has a less sophisticated leaner structure than traditional columns, being provided with lower thickness comparable with the thickness of the parts of the tub (cylindrical body and corresponding perforated closing flange) from which they protrude.

In view of the above, it appears evident that the use of a low thickness allows for reducing the total weight of a tub for washer, as well as reducing the quantity of plastic material to be used and the costs for design and construction of moulds for the two traditional parts of a tub for washers.

Additionally, because of the low thickness, the pins are characterised by rapid cooling after the completion of the moulding process of the two parts of the tub for washers where they are to be incorporated.

This prevents the risk for the structure of each tubular element to be affected by undesired microcavities and, moreover, it allows for considerably reducing the waiting time before extracting the cylindrical body and the perforated flange of a tub from the corresponding moulds.

BRIEF DESCRIPTION OF THE DRAWINGS

For purposes of clarity, the description of the invention continues with reference to the enclosed drawings, which are intended for purposes of illustration only and not in a limiting sense, wherein.

DETAILED DESCRIPTION

Figure 1:
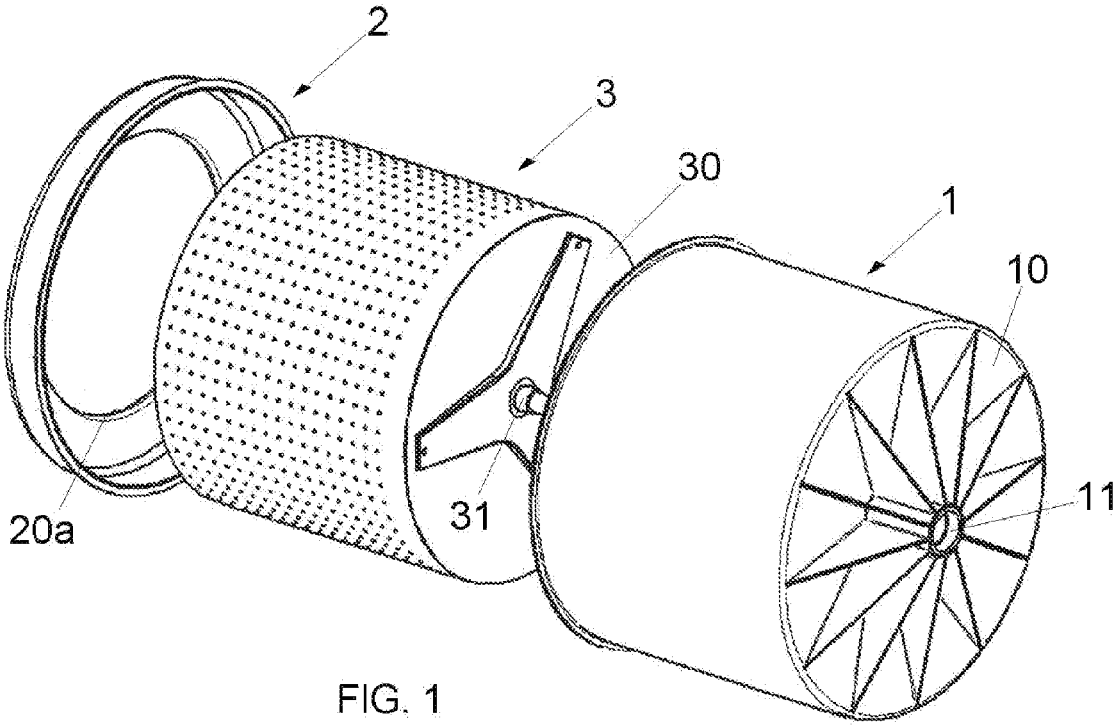
FIG. 1 PRIOR ART
FIG. 1 is a perspective view of a plastic tub in conventional models of washers and washer/dryer combos.
Figure 2:
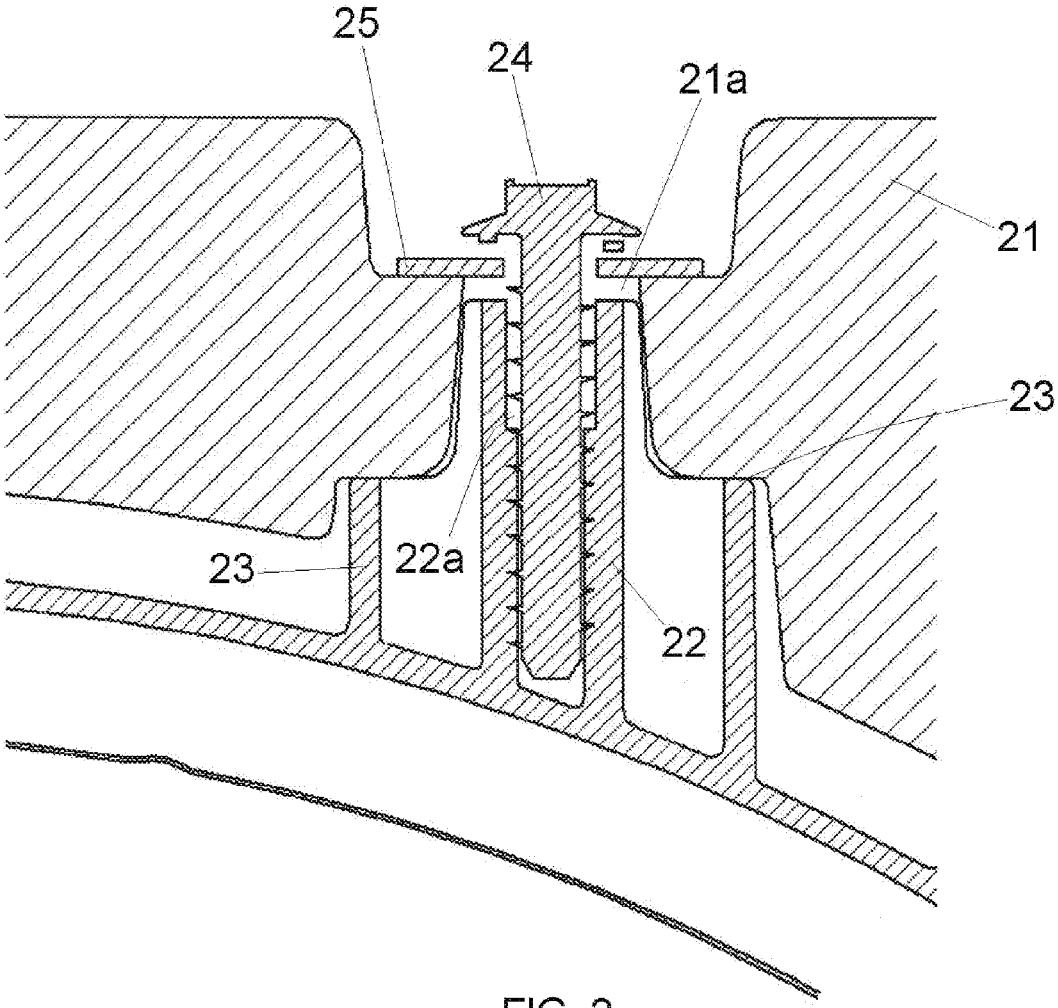
FIG. 2 PRIOR ART
FIG. 2 is an enlarged view showing a structure used in conventional models of washers and washer/dryer combos for anchoring and centering of counterweights.
Figure 3:
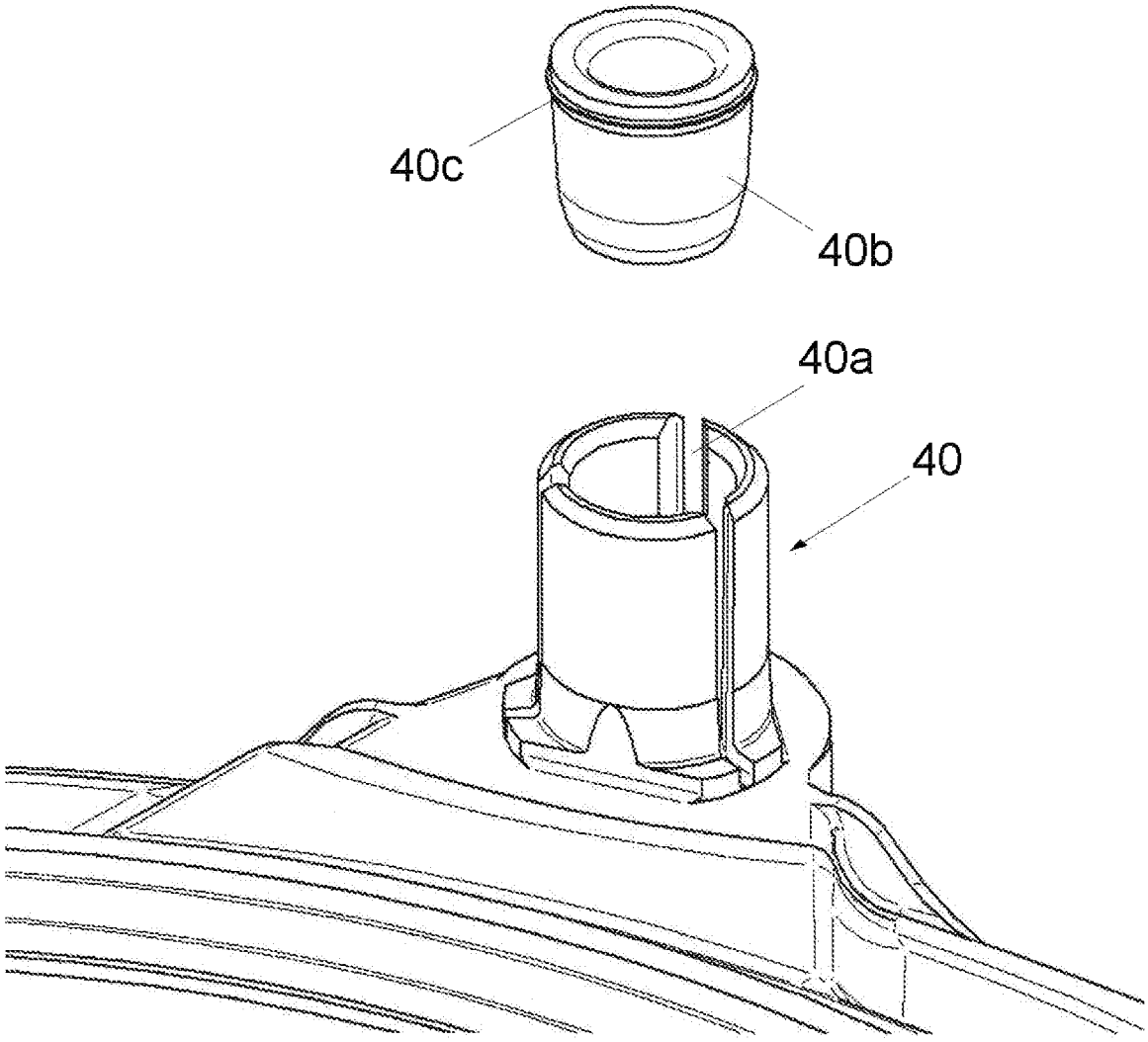
FIG. 3 is an axonometric view of a tubular divaricable element with relevant divaricating insert in non-operational position.
Figure 3A:
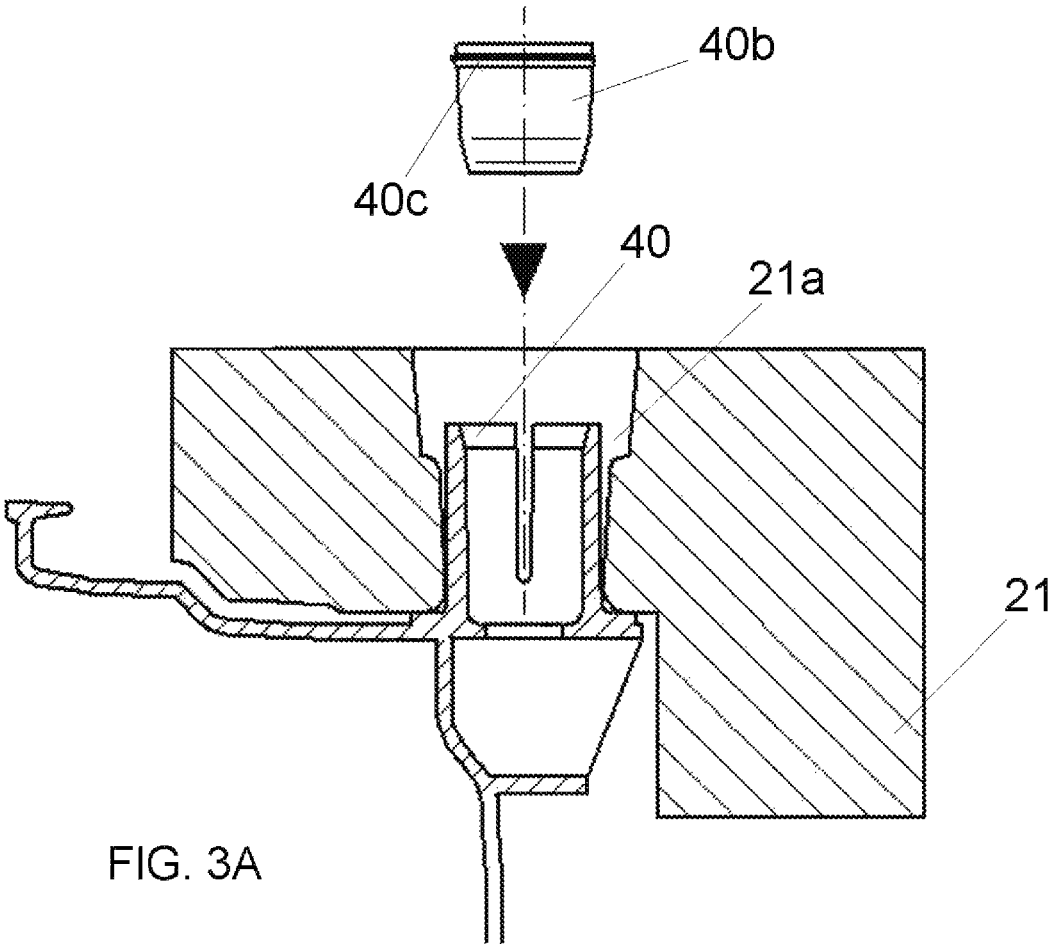
FIG. 3A is a cross-section of FIG. 3 with a vertical plane.
Figure 3B:
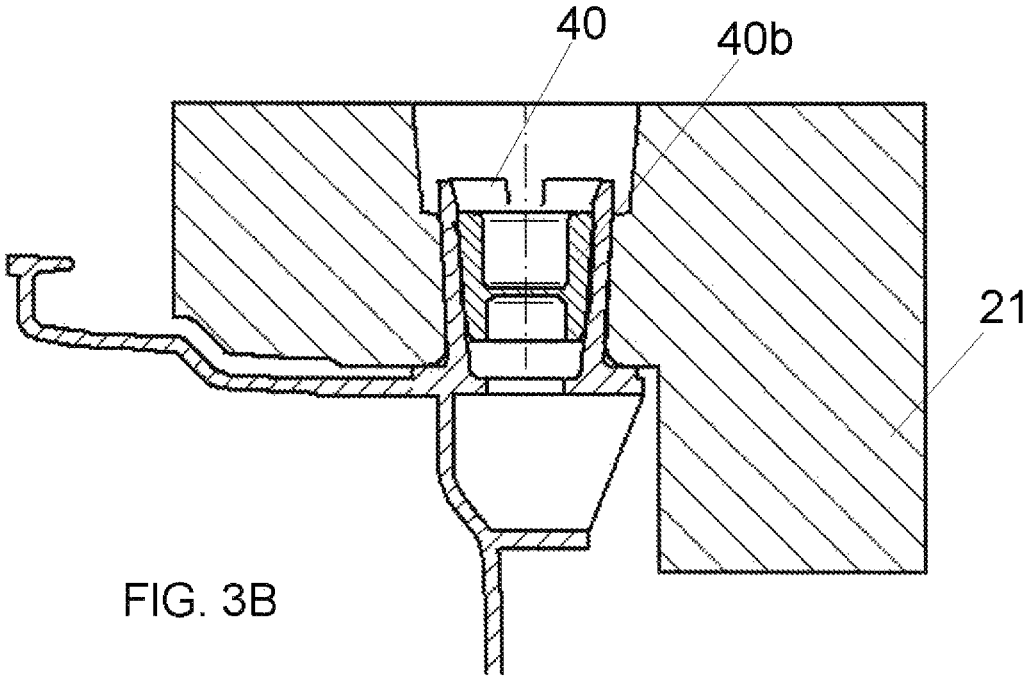
FIG. 3B is the same as FIG. 3A, except for the divaricating insert in operational position.

With reference to FIGS. 3, 3A and 3B, the new system used to anchor concrete counterweight in external position on a plastic moulded tub for washers is based on the presence of a series of cylindrical divaricable pins (40) obtained from the same material and during the same moulding process as the two traditional parts of the tub, that it to say the traditional cylindrical body (1) and the corresponding front closing flange (2).

Each pin (40), which is provided with a regularly spaced set of three longitudinal notches (40*a*), is designed to be inserted from down up into the hole (21*a*) of a counterweight (21) when the counterweight (21) is arranged against the external wall of the tub.

In particular, it must be noted that the hole (21*a*) of the counterweight (21) has a truncated-conical shape with the end with lower cross-section facing the centre of the tub.

Following to penetration inside the hole (21*a*), the pin (40) is given such a position that the free end can be accessed from the upper opening of the hole (21*a*), as shown in FIGS. 3A and 3B.

Now, a corresponding cylindrical truncated-conical insert (40*b*), which is practically a sort of plug provided with a short sharp point, is inserted exactly inside each pin (40).

With reference to FIG. 3B, the forced insertion of the insert (40*b*) generates a divarication of the pin (40) favoured by the presence of the said longitudinal notches (40*a*), in such a way that the pin (40) is given a truncated-conical shape that perfectly matches and strictly adheres to the shape of the hole (21*a*) of the counterweight (21).

The mutual perfect interference between the external walls of the tubular element made of plastic material (40) and the internal walls of the hole (21*a*) of the counterweight (21) guarantees mutual stable resistant coupling, thus providing the stable safe anchoring of the entire counterweight (21) to the tub of the washer.

To further stabilise the coupling of the divaricating insert (40*b*) inside the central cavity of the pin (40), the insert (40*b*) is provided towards the top with a perimeter retention tooth (40*c*) designed to create friction against the internal walls of the pin (40).

Figure 4:
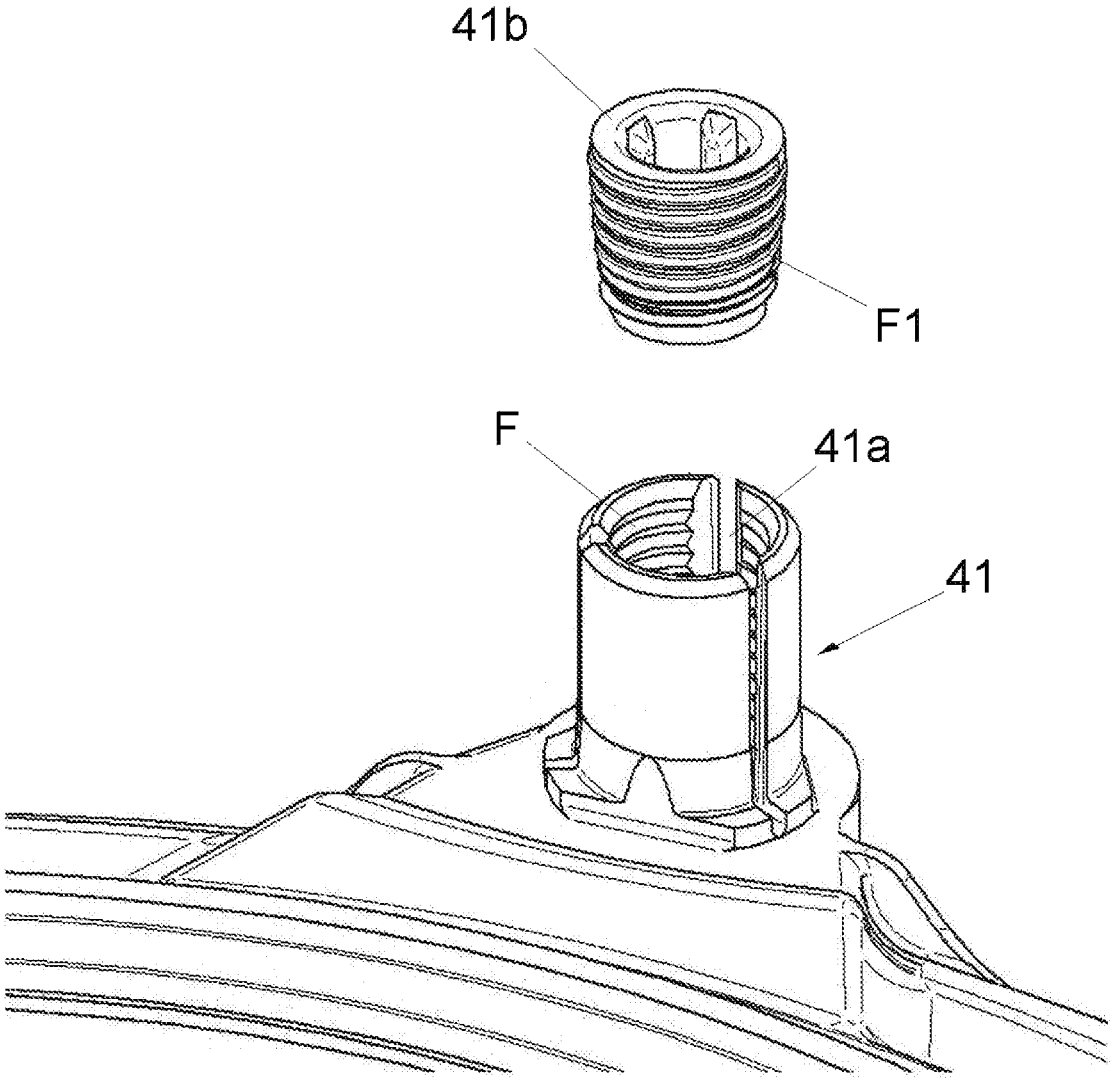
FIGS. 4, 4A and 4B correspond to the three aforementioned figures, except for they refer to an alternative embodiment of the tubular divaricable element.
Figure 4A:
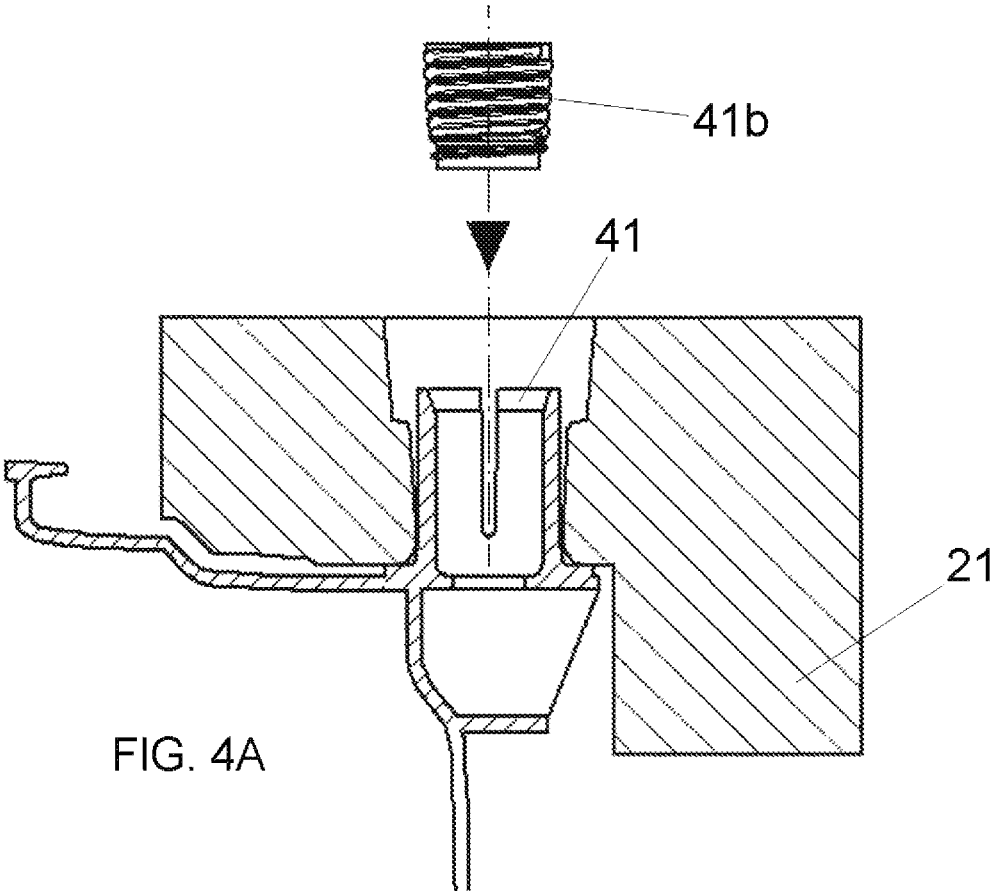
Figure 4B:
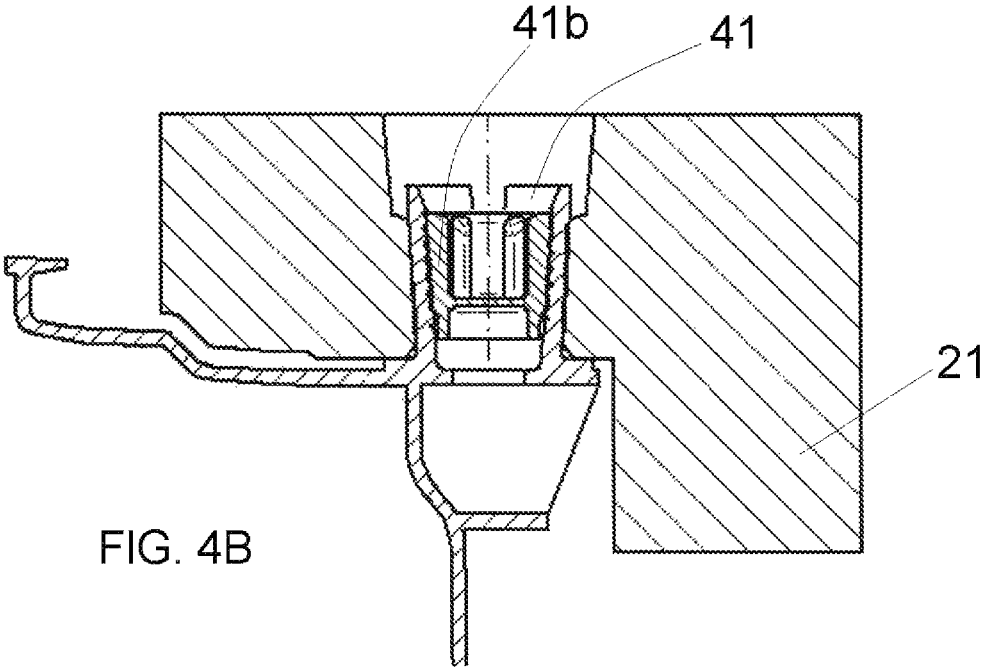

FIGS. 4, 4A and 4B refer to a second embodiment of the said divaricable pin (41) that, while adopting the same structural and functional configuration, is characterised by the fact that it is designed to be coupled in "screw" configuration with the corresponding divaricating insert (41*b*) with truncated-conical shape.

To that purpose, the internal walls of the pin (41) and the external walls of the insert (41*b*) respectively incorporate corresponding threads (F, F1).

In such a situation, the operator in charge of fixing the counterweight (21) in external position on the tub of a washer will screw the divaricated insert (41*b*) until the desired pressure against the internal walls of the hole (21*a*) of the counterweight (21) is obtained on the divaricable walls of the pin (41).

Figure 5:
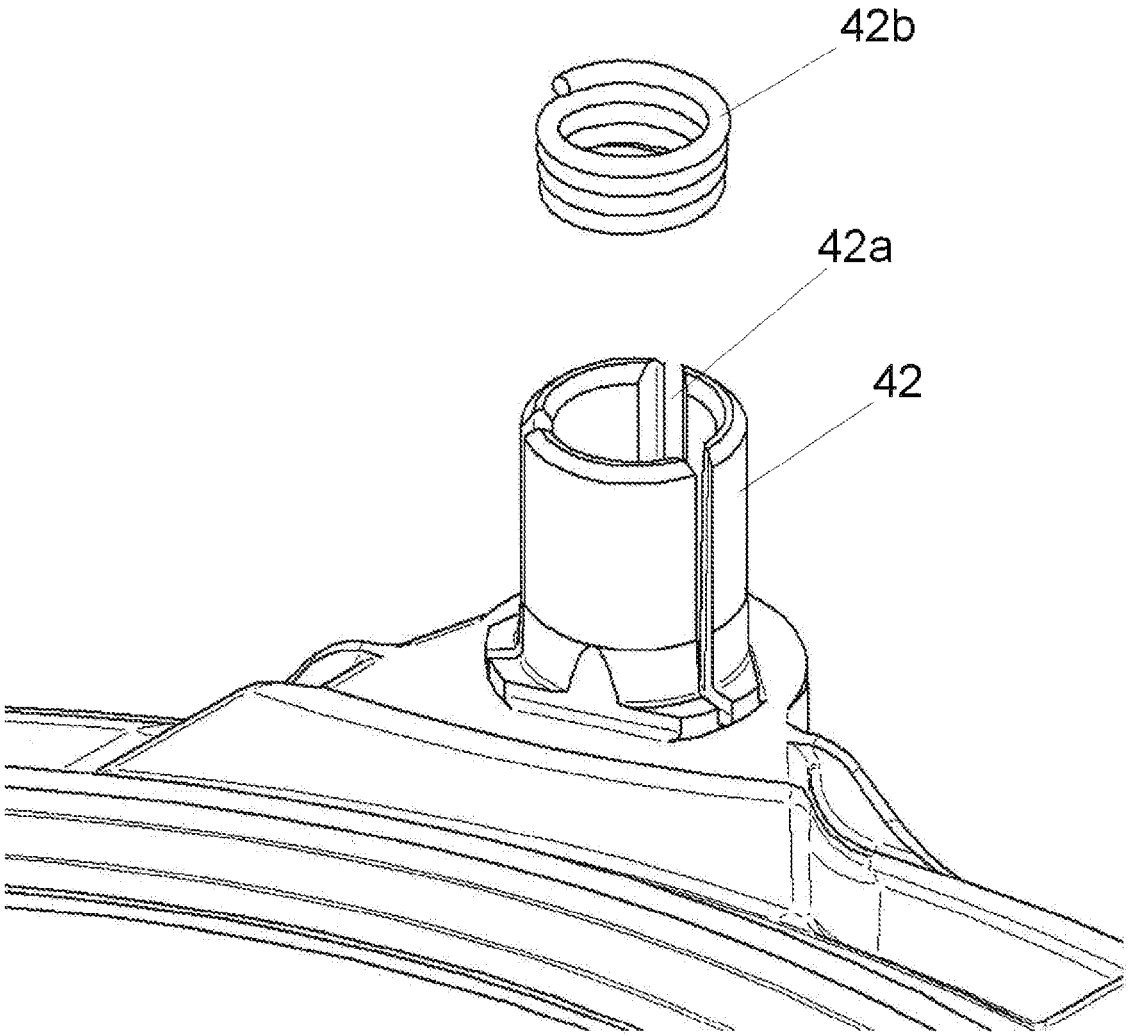
FIGS. 5, 5A and 5B correspond to FIGS. 3, 4A and 3B, except they refer to an additional alternative embodiment of the tubular divaricable element.
Figure 5A:
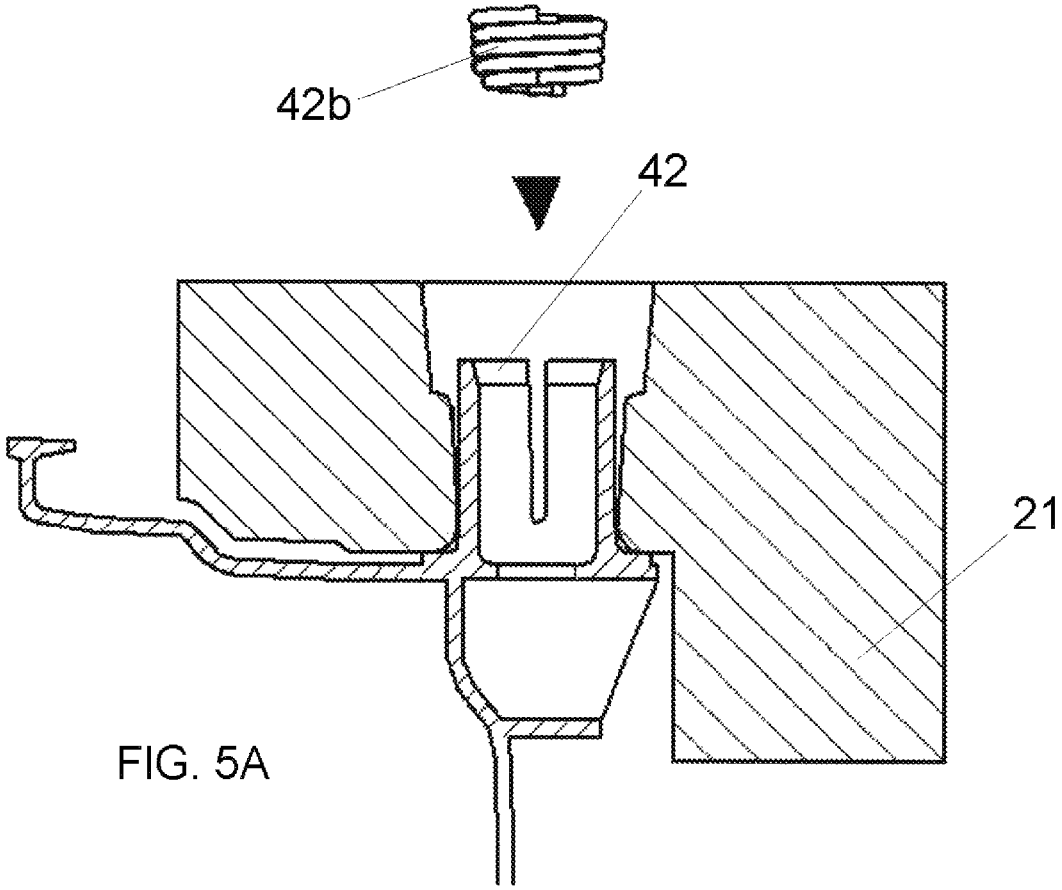
Figure 5B:
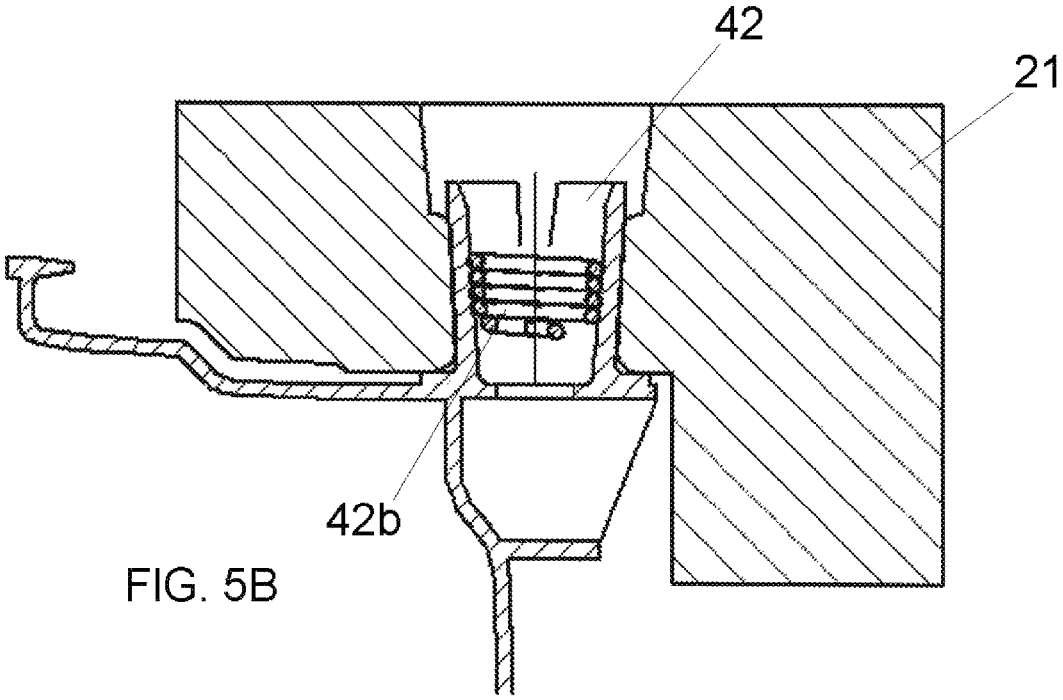

FIGS. 5, 5A and 5B refer to a third embodiment of the divaricable pin (42) that is identical to the embodiment shown in FIGS. 4, 4A and 4B and consequently provided with longitudinal notches (42*a*).

The peculiarity of the said embodiment of the pin (42) refers to the fact that it is provided with a divaricating insert consisting in a helical spring with truncated-conical shape (42*b*) designed to penetrate forcedly into the corresponding tubular element (42) to cause the usual divarication.

In this case, a thread compatible with the turns of the said helical spring (42*b*) can be realised on the internal walls of the pin (42) in order to additionally stabilise the operational position of the spring (42*b*) inside the said pin.

The invention claimed is:

1. An anchoring system of counterweights for washers and washer/dryer combos, said anchoring system comprising:

a plastic moulded tub comprising a cylindrical body and/or a closing flange, at least one counterweight mounted on said cylindrical body and/or closing flange, said counterweight being provided with a truncated-conical hole having a lower end that faces a center of the tub, one or more tubular cylindrical pins with elastic divarication capability, externally provided on said cylindrical body and/or closing flange, each of the pins is configured to penetrate into the corresponding truncated-conical hole, in such a way that a free end of the pin can be accessed from an upper end of the hole of the counterweight, and a divaricating insert with truncated-conical shape, inserted inside each pin to give truncated-conical shape to the pin that allows external walls of the pin to interfere exactly against internal walls of the hole of the counterweight, wherein said divaricating insert is an elastic member a helical spring having the truncated-conical shape before the spring is inserted into the pin.

2. The anchoring system according to claim 1, wherein said pin is provided with internal walls with threads, and said divaricating insert is configured to engage the threads of said pin.

3. The anchoring system according to claim 2, wherein the threads of the pin are compatible with turns of the helical spring.

4. The anchoring system according to claim 1, wherein the pin is provided with longitudinal notches for elastic deformability purposes.

5. An anchoring system of counterweights for washers and washer/dryer combos, said anchoring system comprising:

a tub comprising a body and/or a closing flange;

at least one counterweight mounted on said body and/or closing flange, said at least one counterweight having a truncated-conical hole that has a first end facing the tub and a second end opposite to the first end;

one or more tubular pins with elastic divarication capability, externally provided on said body and/or closing flange, each of the pins is configured to penetrate into the corresponding truncated-conical hole from the first end toward the second end such that the pin has a free end accessible at the second end of the hole; and a divaricating insert having a truncated-conical shape and configured to be inserted inside each pin to expand external walls of the pin to be directly pressed against internal walls of the hole, wherein said divaricating insert is elastically deformable, and said divaricating insert is a spring having the truncated-conical shape before the spring is inserted into the pin.

6. The anchoring system according to claim 5, wherein said divaricating insert is a helical spring.

7. The anchoring system according to claim 6, wherein said pin comprises internal walls with threads, and said divaricating insert is configured to engage the threads of said pin.

8. The anchoring system according to claim 7, wherein the threads of the pin are compatible with turns of the helical spring.

9. The anchoring system according to claim 5, wherein the pin is provided with longitudinal notches for elastic deformability purposes.

* * * * *